United States Patent [19]

Buccicone

[11] 3,977,537

[45] Aug. 31, 1976

[54] SHEET PILING METHOD AND APPARATUS

[75] Inventor: Velio S. Buccicone, Portage, Ind.

[73] Assignee: Bucciconi Engineering Co., Inc., Gary, Ind.

[22] Filed: Jan. 6, 1975

[21] Appl. No.: 538,563

[52] U.S. Cl. ..... 214/6 DS; 214/6 S; 271/64; 271/193; 271/224

[51] Int. Cl.[2] ..... B65G 57/04; B65H 31/20; B65H 31/36

[58] Field of Search ..... 214/6 DS, 6 S, 6 N; 271/64, 193, 223, 224

[56] References Cited

UNITED STATES PATENTS

| | | | |
|---|---|---|---|
| 2,918,852 | 12/1959 | Buccicone | 214/6 N X |
| 3,256,010 | 6/1966 | Buccicone | 271/223 X |
| 3,369,675 | 2/1968 | Buccicone | 214/6 DS X |
| 3,429,466 | 2/1969 | Puderbach | 214/6 P X |
| 3,606,313 | 9/1971 | Buccicone | 271/223 X |
| 3,617,052 | 11/1971 | Buccicone | 271/224 X |
| 3,662,901 | 5/1972 | Brintley, Sr. | 214/6 H |
| 3,802,699 | 4/1974 | Wiig et al. | 271/64 |

*Primary Examiner*—L. J. Paperner
*Attorney, Agent, or Firm*—Guy A. Greenawalt

[57] ABSTRACT

A method and apparatus especially adapted for use in piling sheets in a sheet handling line, in which the sheets are delivered by overhead conveyors of a piling machine to one or more piling areas, where a movable sheet edge guide apparatus is adjustably mounted for co-operation with a pile supporting platform which is positioned in the piling area to receive the sheets in one or more piles or stacks, with a system of controls being provided for coordinating the operations of the conveyors and the edge guiding and pile supporting apparatus so that, when desired, deposit of a plurality of piles of the sheets on the pile supporting platform or platforms in either side-by-side or end-to-end relation, with minimum adjustment of equipment, is possible.

19 Claims, 12 Drawing Figures

97'
104
103
102
100'
105
106
105'
106'
120'
113'
107'
116'
114'
115'
110'
112'
74
108'
80
65
77
72
75
73
9
78
83
112'
110
76
115
108
107
116'
113
114
120
95
98
97
6

93'
92'
90'
88'
94'
87
23
94
93
92
90
88

7
5
87
65
4
80
66
78
65
77
76
72
74
68
110
112
107
116
46
47
85
95
45
70
96
124
96
7
126
86
12
127

MAG. SELECTOR - #1
S1
S2
MAG. SELECTOR - PILER #2
COUNTER
RESET
PILE #1
PILE #2
ALT
AUX. MODE
OFF
ON
INDUCTOSWITCH UNITS

OFF
ON
DN
MAN.
AUTO.
LIFT #1 SELECTOR
LIFT #2 SELECTOR
FOR.
REV.
IN
OUT

SHEET PILING METHOD AND APPARATUS

The invention relates to sheet piling systems and is more particularly concerned with improvements in such systems which take the form of auxiliary sheet edge guiding apparatus for incorporation in a piling operation so as to enable the sheets to be deposited in multiple piles on a single pallet or other support with the piles in side-by-side or end-to-end relation, as desired.

In the handling of metal sheets, particularly, sheets of ferro-magnetic materials, machines have heretofore been developed which will accept, from a shear, or the like, successive sheets of a size up to predetermined maximum dimensions, and deposit the same on a removable pallet, or skid, which enables the piles to be moved from the machine when the piling is completed. Some of these machines have been designed to selectively advance sheets of different shape or dimensions and to deposit selected sheets in more than a single piling area so as to provide separate piles of sheets of the same dimensions, or of like character. A machine of this type, which is capable of piling sheets of a shape other than rectangular, is described in U.S. Pat. No. 3,055,659, granted Sept. 25, 1962, and in U.S. Pat. No. 3,111,311, granted Nov. 19, 1973. A further design of this type machine which employs a scissors-type lift for supporting the piles is described in U.S. Pat. No. 3,369,675. Experience with these machines has indicated the desirability of providing a system or method and apparatus for enabling the piling of multiple piles of sheets in side-byside or end-to-end relation on a single pallet, particularly when relatively small sheets are being handled, the pallets being normally of a size to accommodate a pile of sheets of relatively large size or dimensions and normally used for a single pile of the sheets. It is a general object, therefore, of the present invention to provide a system or method and an apparatus for piling sheet materials which enables a plurality of successive sheets in a processing operation to be deposited in multiple relation on a single pallet, or other support, in a piling area, with the capability of piling the sheets so that the piles or stacks are arranged in either side-by-side or end-to-end relation on the support member.

A more specific object of the invention is to provide a sheet piling system or operation wherein successive sheets are advanced to a selected piling area for deposit in a pile on a pallet or other support and upon accumulation of a pile of predetermined size provision is made for adjusting the operation to deposit further sheets in an area immediately adjoining the completed pile so as to enable a plurality of piles to be deposited on a single pallet or similar support member.

Another object of the invention is to provide a sheet piling or stacking apparatus wherein auxiliary apparatus is provided for incorporation in a sheet piling machine which is in the form of a carriage adapted to be movably mounted on the sheet piling machine and have adjustable side guides positioned on the carriage for co-operation with adjustable back stop and end stop mechanisms so as to facilitate the piling or stacking operation of sheets of less than the normal size which the basic machine is capable of handling and to deposit the sheets in multiple stacks or piles in side-by-side or end-to-end relation on a stack receiving platform or in a piling area which normally receives only a single pile or stack of sheets.

These and other objects and advantages of the invention will be apparent from a consideration of the sheet piling apparatus which is shown by way of illustration in the accompanying drawings wherein.

Figures 1, 2, 9, 10:
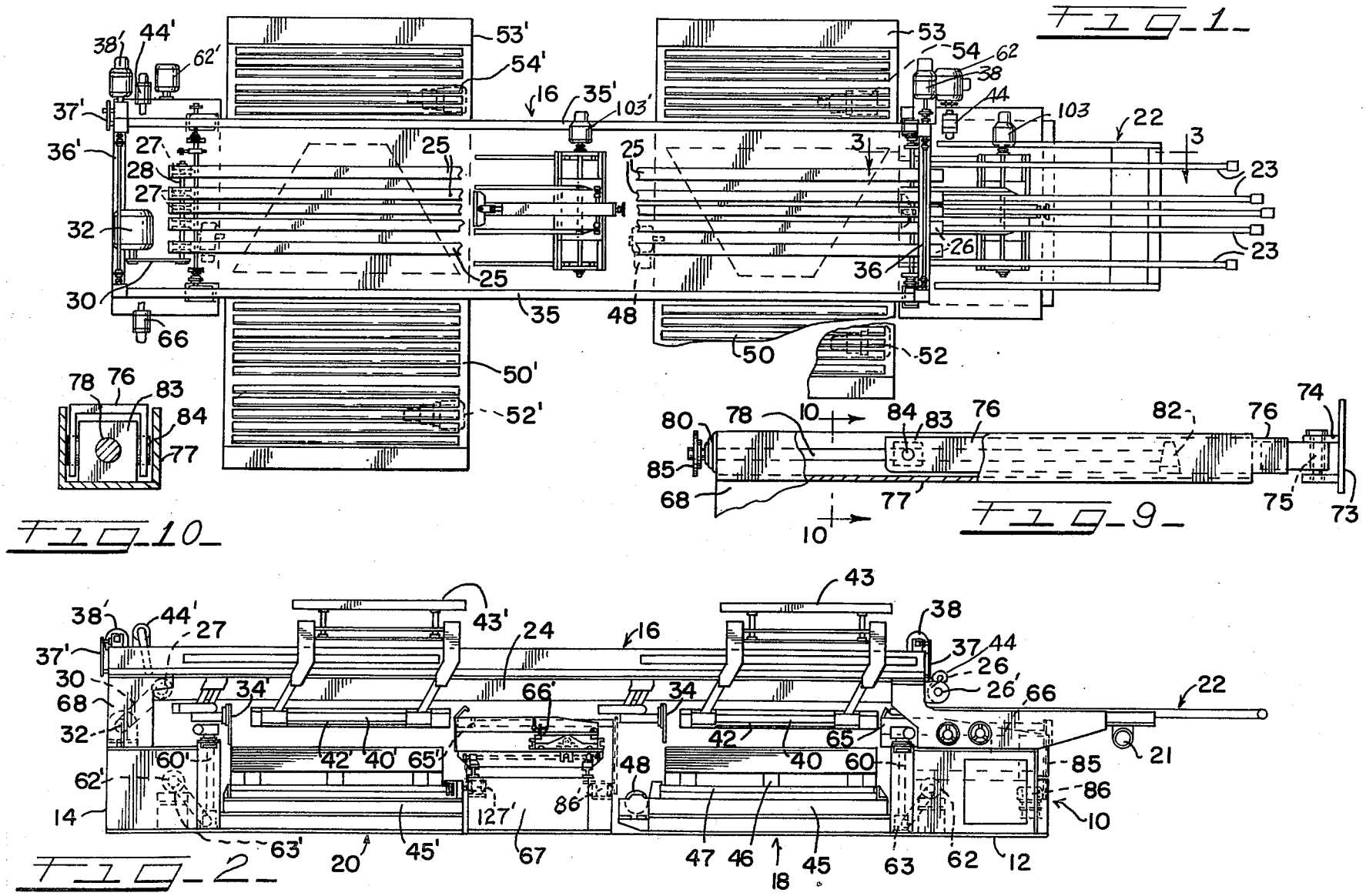
FIG. 1 is a plan view, largely schematic and with parts omitted, showing a piling machine for metal sheets which has dual piling areas and associated apparatus embodying the invention for piling or stacking sheets in the piling area either in single piles or stacks, or in multiples thereof.
FIG. 2 is a side elevational view, largely schematic and with parts omitted, showing the dual piling machine of FIG. 1.
FIG. 9 is a sectional view, taken on the line 9—9 of FIG. 4.
FIG. 10 is a fragmentary sectional view taken on the line 10—10 of FIG. 9.

Referring first to FIGS. 1 and 2 of the drawings, there is illustrated a piling machine for handling metal sheets in which provision is made for piling or stacking in two piling areas or two piler boxes, which piling areas or boxes are in longitudinal alignment. The machine comprises a main frame 10 which includes upstanding end frames 12 and 14, with the former being at the infeed end of the machine. A rectangular top frame 16 extends between and connects the end frames 12 and 14 above longitudinally aligned and spaced piling areas or piling boxes 18 and 20. The conveyor equipment 22 for advancing the sheet material and depositing the sheets in the two piling areas 18 and 20 is supported on the end and overhead frame members 12, 14 and 16 while pile receiving apparatus is mounted in each of the piling areas 18 and 20. The basic arrangement of the machine corresponds to the arrangement shown in U.S. Pat. No. 3,055,659, granted Sept. 25, 1962, and U.S. Pat. No. 3,369,675, granted Feb. 20, 1968.

At the entrance end of the machine there is provided a conveyor arrangement 22 of infeed conveyor units 23 which may be constructed according to the description of the infeed conveyor apparatus in U.S. Pat. No. 3,055,659 and U.S. Pat. No. 3,111,311, granted Nov. 19, 1963. The conveyor elements or units 23 in the infeed structure 22 are mounted in longitudinal and parallel relation and are adjustably positioned in the direction lengthwise of the machine to best handle sheets of the size and configuration it is desired to stack or pile. The infeed conveyor structure 22 is adapted to advance sheets from a shear (not shown), or other supply source, to an elongate overhead conveyor structure 24. It may be driven from a cross shaft as in U.S. Pat. No. 3,055,659, but with the cross shaft powered by a motor assembly indicated at 21 in FIG. 2, which is supported on the frame structure.

The conveyor structure 24 comprises, preferably, one or more electromagnetic rail units 24 (FIG. 1) which are constructed, for example, in accordance with the disclosure in Buccicone U.S. Pat. Nos. 2,600,475, dated June 17, 1952; 2,642,174, dated June 16, 1953; and 3,229,805, dated Jan. 18, 1966. It is understood, however, that it is not intended to limit the mechanism herein disclosed to the use of magnetic rail-type conveyors but it is contemplated that other types of overhead conveyors could be used, where desirable. The overhead conveyor structure 24 advances the sheets for deposit in the stacking or piling areas 18 or 20, or for passage out of the machine. The conveyor rail units 25 are supported on cross beams (not shown) which are in turn supported on the main frame structure 10. Each unit 25 includes traveling belt members (not shown) supported on idler pulleys 26 (FIG. 2) carried on a suitably supported cross shaft 26', at the entrance end of the machine, and on the driven pulleys 27, at the opposite end of the machine, which pulleys 27 are mounted on a suitably supported cross shaft 28 having a pulley and belt drive connection 30 with a motor drive assembly 32 mounted on the end frame structure 14.

End stop mechanisms 34, 34' are mounted in cross frames (not shown) which are longitudinally adjustable on the top longitudinal side beam members 35, 35' of the top frame structure 16, each of which has enclosed therein or mounted thereon adjusting screws (not shown) to which the end stop cross frames are connected for longitudinal movement. The adjusting screws have right angle connections with the cross shafts 36, 36' at the ends of the machine frame which, in turn, have drive connections, indicated at 37, 37', with drive motors 38, 38' mounted at the opposite ends of the longitudinal beams 35'. The end stop mechanisms 34, 34' are adjustable longitudinally of the machine relative to the associated piler areas 18, 20 so as to position the same at the proper location for deposit of the sheets at the desired location in the respective piling area.

Side guide mechanisms 40, 40' are provided at each of the piler areas 18 and 20. These mechanisms comprise pairs of elongate, longitudinally extending, laterally adjustable side guide plates 42, 42' which depend from cross frames 43, 43' carried on the top frame structure 16. Each pair of the side guide plates 42, 42' is adjustable laterally of the machine so as to accommodate a variety of sheet widths within predetermined limits. The illustrated side guide mechanisms are of the type which may be constructed and mounted as shown in U.S. Pat. Nos. 3,256,011, granted June 14, 1966, or 3,369,675, granted Feb. 20, 1968. The lateral adjusting drive motor assemblies are indicated at 44, 44'.

The two piling or stacking areas 18 and 20 (FIG. 2) are in the form of longitudinally aligned boxes located below the conveyor structure 24, with the leading and trailing sides closed or obstructed and the lateral sides open so as to enable empty pallets to be moved into the proper boxes and to be removed out of the side of the machine when sheets are stacked thereon by the machine. The two box-like areas 18 and 20 are provided with lift assemblies 45, 45' which, in the illustrated machine, are of identical construction and only one will be described, with corresponding elements of the other indicated by the same numerals primed. The left assembly 45 in the piling area 18 comprises a pallet forming member 46 on which the sheets are supported while one or more stacks or piles of the sheets accumulate. The pallet member 46 rests on a driven roller bed or lift table 47 of a scissors-type lift assembly which may be constructed according to the disclosure in U.S. Pat. No. 3,369,675 to which resort may be had for details not described herein. The rolls on the roller bed 47 are driven by connection with a drive motor assembly 48 for moving the loaded pallet, when required, laterally of the machine onto the pack conveyor 50 which has rollers driven by a suitable motor drive assembly, indicated at 52 in FIG. 1. A pallet conveyor 53 is provided at the opposite side of the machine for feeding empty pallets onto the lift table 47 which conveyor 53 is driven by the drive motor assembly 54. The lift assembly 45 is carried in a vertical path by means of end brackets (not shown) which rest on nut arrangements (not shown) which are carried up and down in vertically disposed screw post members 60. The screw post members 60 are housed in the cross frame structures 12 and 14 and are driven by suitable drive connection with drive motor assembly 62 through belt or chain drive and shaft connected right angle gear boxes 63.

At the entrance end of each of the piler areas 18 and 20, which is the trailing or back end in relation to the advancing movement of the sheets, there is provided a back stop mechanism 65, 65' and an auxiliary side edge guide mechanism 66, 66' which enables the piling or stacking of smaller than normal size sheets into multiple piles or stacks in each of the piling or stacking areas 18 and 20. The back stop mechanism 65 and associated auxiliary side guide mechanism 66 for the piling area 18 are mounted on the entrance end cross frame structure 12 while the back stop mechanism 65' and associated auxiliary side guide mechanism 66' for the piling area 20 are mounted on an intermediate cross frame structure 67 which is disposed between the two piler boxes 18 and 20. The two associated back stop and auxiliary side guide mechanisms 65, 66 and 65', 66' are constructed and operated in an identical manner and only one will be described, corresponding details or parts of the other one being identified by the same numerals primed.

Figure 4:
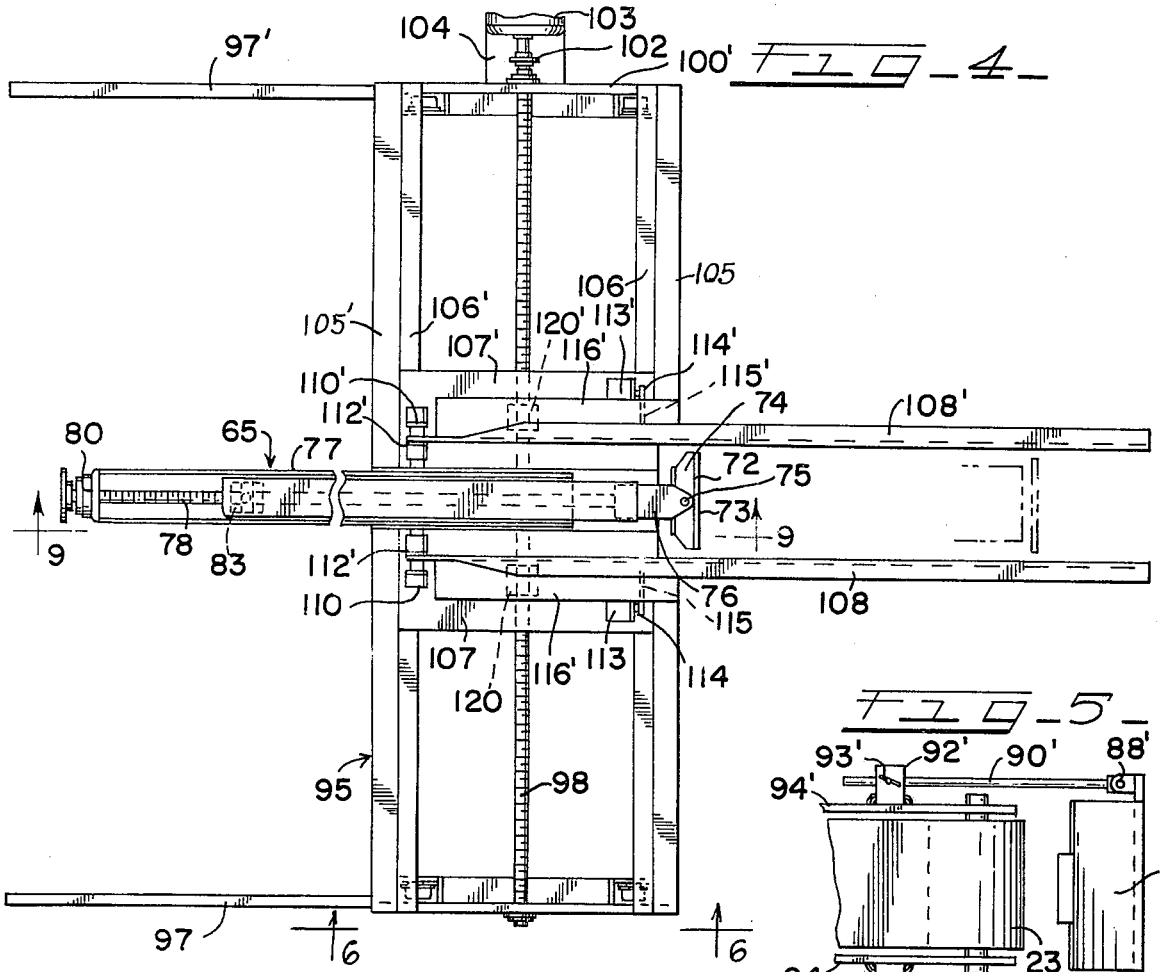
FIG. 4 is a view taken on the line 4—4 of FIG. 3.

The back stop mechanism 65 (FIGS. 3 and 4) is mounted in cantilever arrangement on a bracket 68 (FIG. 3) upstanding at the center of the machine and in a longitudinally extending vertical plane. The bracket 68 is mounted at the rearward or trailing side of the end cross frame 12 with the back stop mechanism 65 extending forwardly and overhanging the forward portion of the top 70 in the center portion of the end frame structure 12. The back stop mechanism 65 may be the type shown in copending application Ser. No. 523,418, filed Nov. 13, 1974, for a Dual Sheet Piling Machine. It comprises a back stop plate 72 (FIGS. 3, 4, 9 and 10) having a sheet edge engaging face 73 disposed in a vertical plane and carried on a support frame 74 which is connected by a vertical pivot 74 at one end of a slide bar 76. The slide bar 76 is supported in an elongate housing 77 of U-shaped cross section (FIG. 10) which housing 77 is mounted on the bracket 68 so as to provide an upwardly opening top face. An elongate adjusting screw 78 is mounted at one end in a bearing 80 in the forward end of the housing 77 and at the other end in bearing block 82 located near the trailing end of the housing 77. A trunnion type nut 83 is mounted on the adjusting screw 78. The slide bar 76, which is of inverted U-shaped cross section, straddles the screw 78 and nut 83 with its end pivotally connected thereto by a transverse pivot 84 so as to enable the slide bar 76 to pivot upwardly in the event the lift assembly 45 is raised a sufficient distance to strike the back stop plate 72, thereby avoiding risk of damage to the mechanism by improper use or careless operation of the lift assembly 45. The back stop adjusting screw 78 is connected by a sprocket and chain drive, indicated at 85, with drive motor assembly 86, the latter being suitably mounted on the end frame structure 12.

Figure 5:
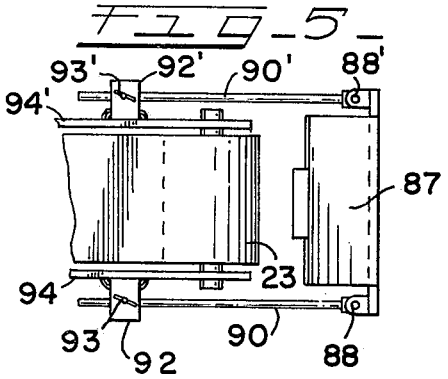
FIG. 5 is a fragmentary plan view, to an enlarged scale, the view being taken on the line 5—5 of FIG. 3.

A top portion 87 (FIGS. 3 and 5) of the back stop plate 72 is preferably mounted on the leading end of the center infeed conveyor assembly 23 so as to enable the top portion 87 to be positioned, along with the associated infeed conveyor member 23 for forming another pile or stack when a previously formed pile interferes with, or obstructs, the movement of the bottom portion of the back stop plate 72. The back stop plate portion 87 may be mounted at opposite vertical side edges by means of pivot pins 88, 88' on the ends of parallel, laterally spaced support bar members 90, 90' which are in turn mounted for longitudinal adjustment by means of brackets or lugs 92, 92' and clamping elements 93, 93' on the side plates 94, 94' of the infeed or entry conveyor assembly 23, enabling the plate portion 87 to be adjustably positioned longitudinally of the machine and to be set at the desired angle for contact by the edges of the sheets being handled. Alternate arrangements for mounting the movable top portion 87 of the back stop assembly comprise providing a separable unit with clamps for adjustable attachment to auxiliary side edge guide members hereinafter described or the top portion 87 may be adjustably mounted on the end stop mechanism 34.

The auxiliary side edge guide apparatus 66 which is employed in forming multiple piles in the piling area 18 comprises a main carriage structure 95 (FIGS. 3, 4, 6 and 7) of elongate, generally rectangular construction which is supported in transversely extending relation on the end frame structure by means of wheel or roll members 96 at the four corners of the carriage, which wheel members ride on parallel, longitudinal tracks 97, 97' (FIG. 4) positioned on the horizontally disposed top or shelf 70 of the end frame structure 12. The carriage 95 extends on opposite sides of the back stop structure 65 and supports a right and left hand threaded screw member 98 which is journaled at opposite ends in vertical side plates 100, 100' and is connected at one end by chain drive 102 with a drive motor assembly 103 which is supported on a mounting bracket 104 on the one side frame plate 100'. Parallel, spaced frame members, in the form of channel beams 105, 105' extend between the side frame plates 100, 100' and on their oppositely disposed webs support guiding and supporting rail members 106, 106' for adjustably positioning carriage forming assemblies 107, 107' on which side edge guide members 108, 108' are mounted. The side edge guide plates 108, 108' are pivotally connected at 110, 110' (FIGS. 3, 4, 6 and 8) to the vertically disposed plate members of angle brackets 112, 112' on the carriages 107, 107', so as to enable upward swinging movement of the side guide members 108, 108' in order to prevent damage to the same in the event the lift 45 is inadvertently raised too high so as to strike the extended ends of the side guides 108, 108'. On each of the carriages 107, 107' an upstanding bracket member 113, 113' (FIGS. 3, 4, 6 and 7) is mounted outboard of the side guide plates 108, 108' which carries a cam roll 114, 114' positioned to ride on a track member 115, 115' on the vertical face of the associated guide member 108, 108' so as to steady the guide member in operation and prevent sideways movement.

The carriages 107, 107' (FIGS. 6 to 8) are separable from the main carriage structure 95. Each carriage comprises a base forming plate member 116, 116' extending lengthwise of the machine on the ends of which there are depending guide forming angle members 117, 117' which ride on the guide rails 106, 106' and a pair of depending, spaced plate members 118, 118' positioned to straddle a traveling nut member 120, 120' on the threaded adjusting shaft 98. The guide rails 117, 117' have cap plates 122, 122' bolted onto the bottom of the inside flanges which may be removed so that the two carriages 107, 107' may be lifted off the adjusting nuts 120, 120' and the guide rails or bars 106, 106' for disassembly of the apparatus.

Figure 3:
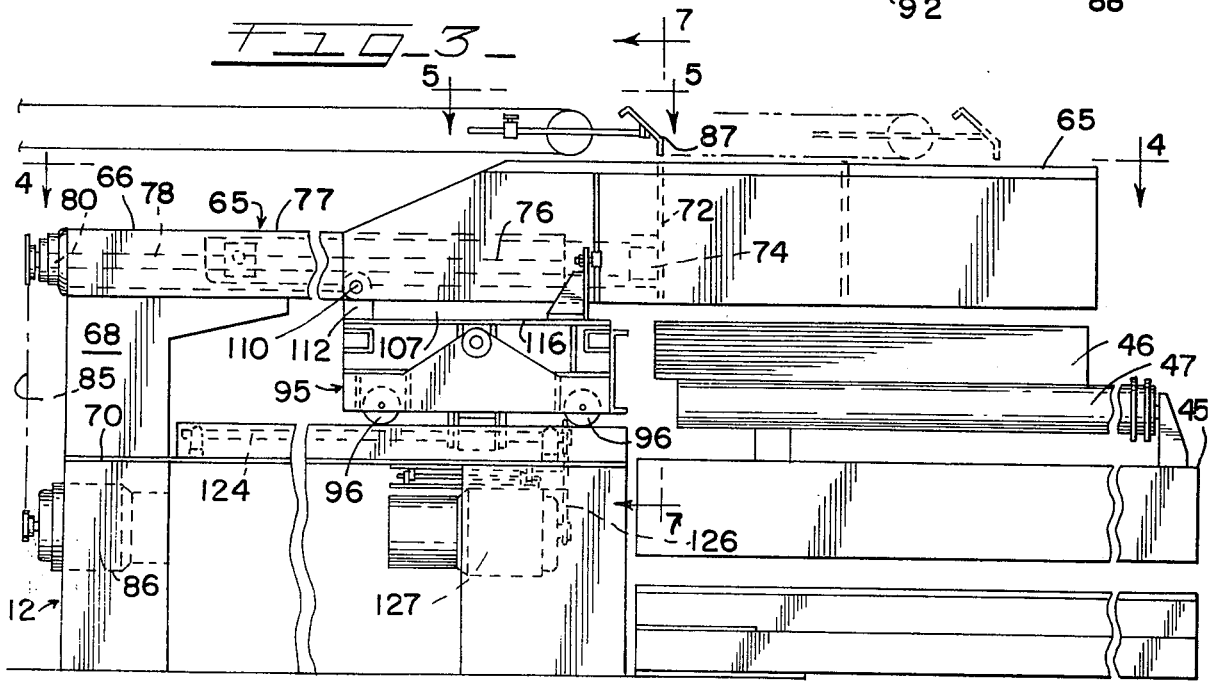
FIG. 3 is a view taken on line 3—3 of FIG. 1 to a larger scale and with portions broken away and other portions omitted.
Figure 7:
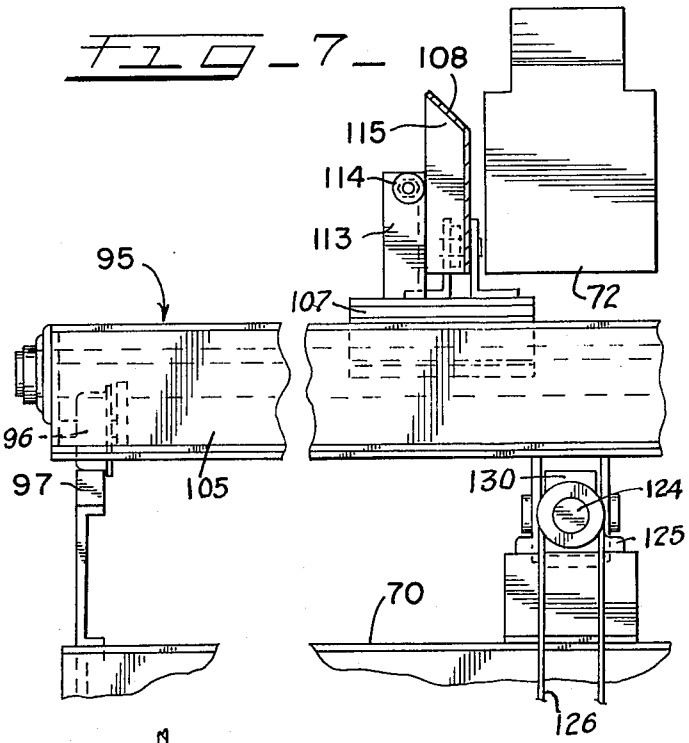
FIG. 7 is a sectional view taken on the line 7—7 of FIG. 3.
Figure 8:
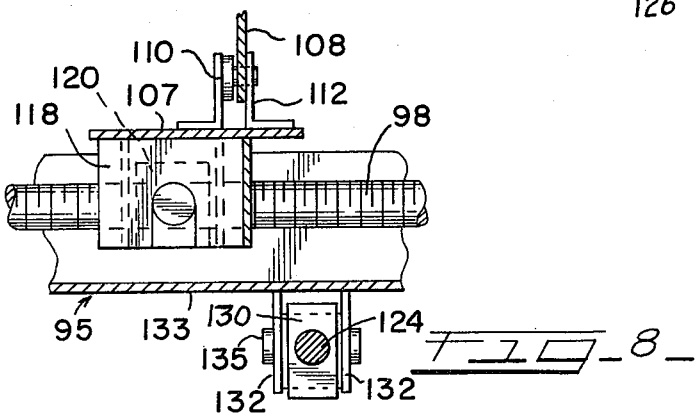
FIG. 8 is a fragmentary cross section taken on line 8—8 of FIG. 6.
Figure 6:
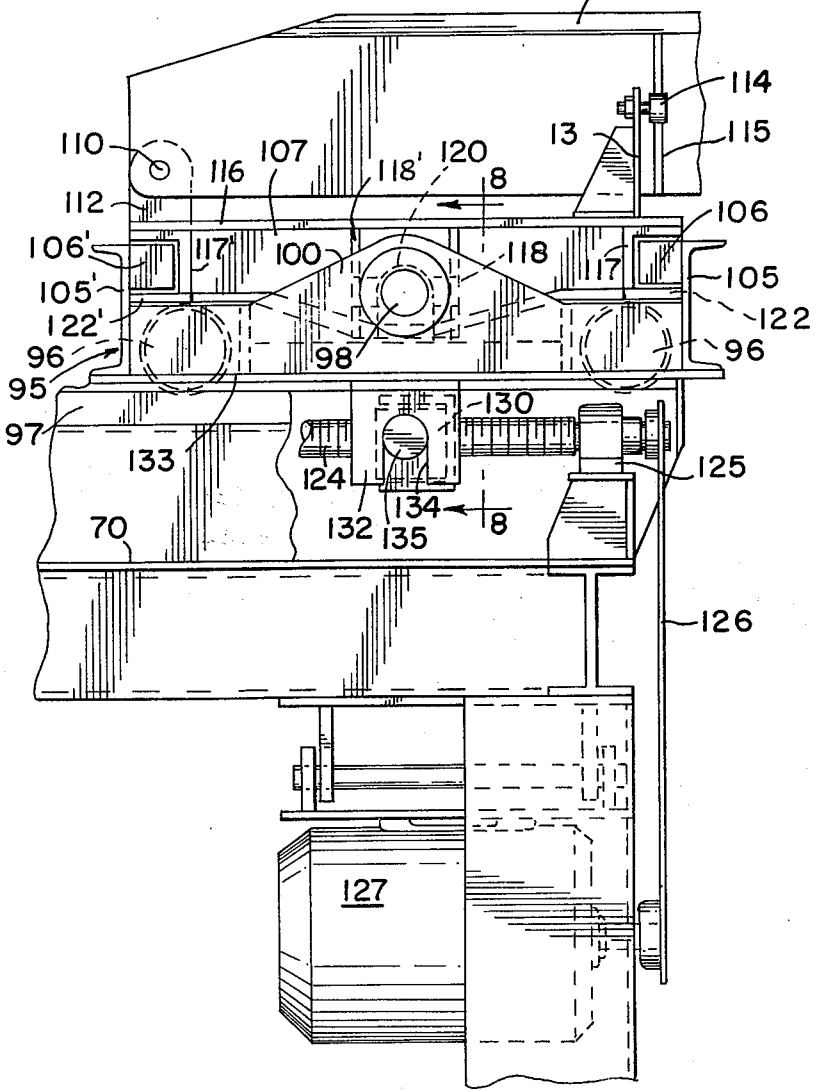
FIG. 6 is a sectional view, to an enlarged scale, the view being taken on the line 6—6 of FIG. 4.

The main carriage frame 95 is connected to a longitudinally disposed adjusting shaft or screw 124 (FIGS. 3, 6, 7 and 8) which is mounted centrally of the machine on the top shelf 70 of the end frame 12 by means of bearing members 125 at opposite ends thereof and driven by a sprocket and chain drive connection 126 with a drive motor 127 supported on the end frame 12. A trunnion type not 130 is mounted on the adjusting screw 124. A pair of spaced plates 132 depend from the floor 133 of the carriage 95 which are slotted at 134 so as to straddle the nut 130 and ride on the trunnion pin 135. Travel of the nut 130 on the adjusting screw 124, of course, positions the carriage 95 in extended relation, as shown in FIGS. 3 and 6, or in the retracted, out-of-the-way position, as shown in FIG. 2, enabling the auxiliary apparatus 66 to be used in multiple piling of small sheets or to be retracted to a position which enables operation of the normal side guides 40 for piling of the larger size sheets. The auxiliary apparatus 66' is constructed, mounted on the cross frame 67, and operated in the same manner as the apparatus 66 for piling in the piler box 20. While the carriage members 95 and 107, 107' are moved or adjusted by operation of the motor driven screw shafts 98 and 124 it may be desirable to effect the movement of the carriages by hydraulic cylinders or other suitable means.

The mechanical operation of the apparatus will be apparent from the foregoing description. A system of electrical controls with manually settable control elements connected in electrical circuits is provided for controlling the operation of the various conveyors and the auxiliary apparatus so as to enable an operator to manually set the control elements for several modes of operation.

Figures 11, 12:
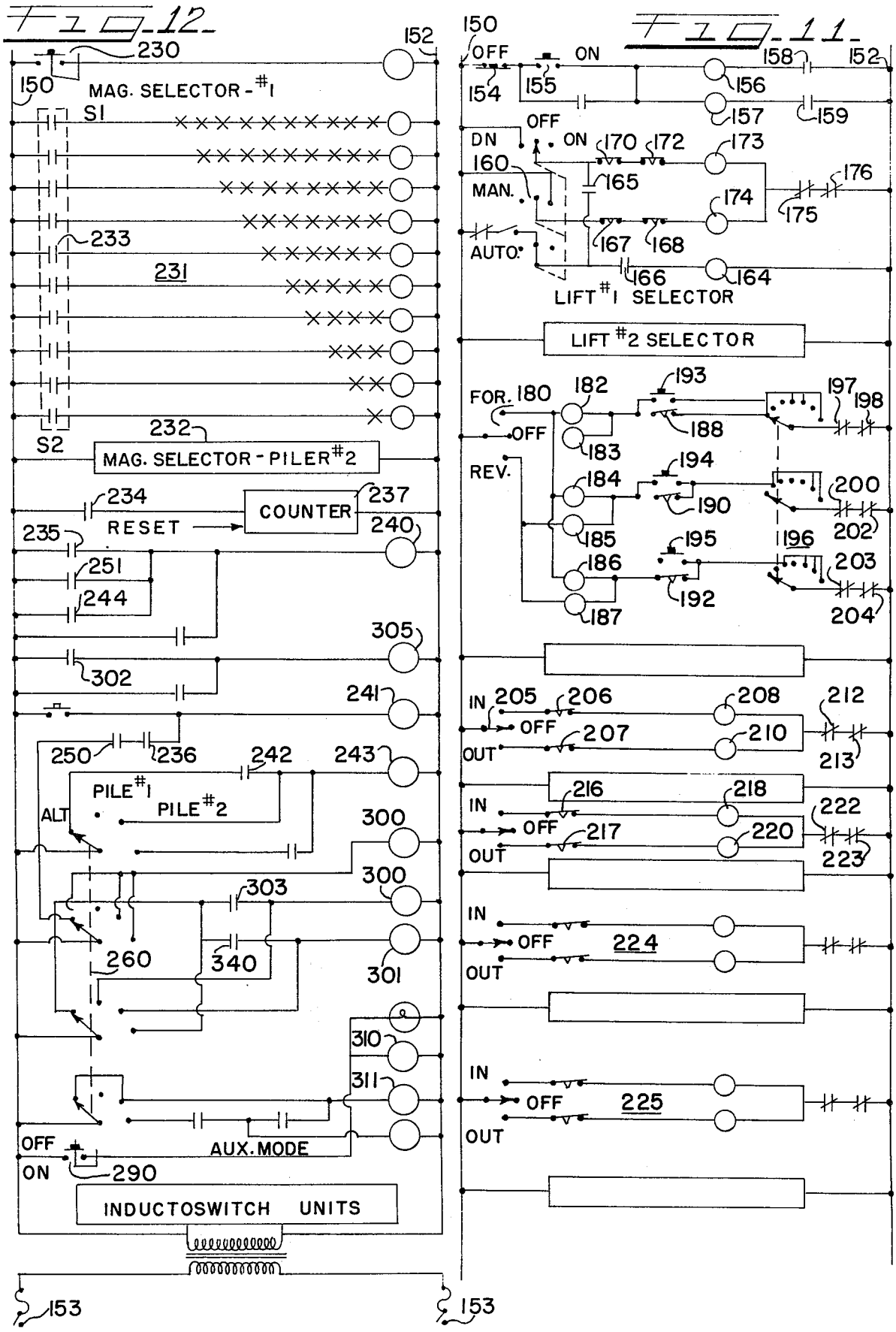
FIGS. 11 and 12 are electrical diagrams illustrating the manner in which the operation of the machine in FIG. 1 is controlled.

The operation of the machine is under the control of an operator with manually settable electrical control elements connected in the electrical circuits as illustrated in FIGS. 11 and 12 to be described hereinafter. The circuits of FIG. 11 control the operation of the various drive motors of the conveying system of the piling machine. Each of the separate control portions of the circuit of FIGS. 11 and 12 is connected in parallel across power buses 150 and 152 which are connected to a 110 volt AC power source at input terminals 153.

Specifically, the control circuit of FIG. 11 controls the operation of the entry conveyor drive motor 21, the main magnetic conveyor drive motor 32, and the lift assembly drive motors 62 and 62', the pallet conveyor drive motors 54 and 54', the lift roll drive motors 48 and 48', the pack conveyor drive motors 52 and 52', the end stop drive motors 38 and 38', the main side guide motors 44 and 44', the auxiliary side guide carriage drive motors 127 and 127', and the auxiliary side guide adjusting motors 103 and 103', for the first and second piling areas 18 and 20, respectively. The control portions for the drive motors of the second piling area 20 are shown in block form inasmuch as they are identical to the control portions for the drive motors of the first piling area 18 which are fully shown and described herein.

The control portion for the entry conveyor 22 (FIG. 11) and the main magnetic conveyor 24 comprises off and on switches 154 and 155, respectively, starter contactor coils 156 and 157 for the entry conveyor and main magnetic conveyor drive motors 21 and 32, respectively, and overload contactors 158 and 159. When switch 155 is placed in the "ON" position, the power across buses 150 and 152 will be applied to the entry conveyor and the main magnetic conveyor drive motor starter contactor coils 156 and 157 to activate their respective drive motors. Overload contactors 158 and 159 protect the starter windings from excessive currents and will open should an overload current situation exist. While a control circuit for single phase motors have been herein described, it, of course, can be appreciated that a similar control circuit for three phase motors could be substituted.

The lift assembly drive motor control portion comprises a three-position three-section spring loaded switch 160, time delay relay 164 having contacts 165, proximity switch 166, limit switches 167, 168, 170 and 172, lift assembly drive motor starter windings 173 and 174, and overload contactors 175 and 176. Starter winding 173 activates the lift assembly drive motor in the down direction and starter winding 174 activates it in the up direction.

When proximity switch 166 is activated, the time delay relay 164 will be set for a predetermined period, for example, 3 seconds. After the predetermined period has elapsed, and assuming switch 160 is in the "DN" position, relay contacts 165 will close to apply power to the down starter winding 173. When the pallet has lowered a sufficient distance, the level of the sheet pile will be far enough from proximity switch 166 to cause it to open to thus stop the lowering of the pallet. The time delay relay 163 is provided to prevent the pallet from being lowered merely due to a steel sheet passing by the proximity switch.

Limit switches 170 and 172 limit the degree of upward travel while limit switches 167 and 168 limit the degree of downward travel. Overload contactors 175 and 176 protect the starter windings from over-current conditions.

The control portion for controlling the pallet conveyor drive motor 54, the lift roll conveyor drive motor 48 and the pack conveyor drive motor 52 comprises a three position switch 180, forward and reverse starter windings 182 and 183, respectively, of the pallet conveyor drive motor 54, forward and reverse starter windings 184 and 185, respectively, of the lift roll drive motor 48, forward and reverse starter windings 186 and 187, respectively, of the pack conveyor drive motor 52, limit switches 188, 190 and 192 and respective override switches 193, 194, a seven position three section drive motor selector switch 196 and overload contactors 197, 198, 200, 202, 203 and 204.

Switch 180 is utilized to activate either the forward or reverse starter windings or none of them. Limit switches 188, 190 and 192 control the maximum degree of travel of the pallet conveyor, lift roll conveyor and pack conveyor, respectively, and will open to deactivate the respective drive motors when the maximum degree of travel is reached.

Switch 196 provides for selecting which drive motor combination of drive motors is to be activated. This is fully described and in accordance with the copending patent application Ser. No. 523,418, filed Nov. 2, 1974, in the name of Velio S. Buccicone, and which is assigned to the assignee of the present invention.

Overrides 193, 194 and 195 may be used to selectively override the respective limit switches. Overload contactors 197, 198, 200, 202, 203 and 204 provide overcurrent protection for the starter windings.

The end stop and side guide drive motor control portions comprise three position switches 205, limit switches 206, 207, 216, 217, end stop drive motor starter coils 208, and 210, side guide drive motor starter coils 218 and 220 and overload contactors 212, 213, 222 and 223.

Switch 205 controls the in and out operation of the end stop mechanism 34. It is preferably spring loaded so that it will naturally return to the off position when not in use. Starter coil 208 activates the end stop drive motor 38 to decrease the end stop distance and starter coil 210 causes the end stop drive motor to increase the end stop distance. Limit switches 206 and 207 control the maximum degree of end stop adjustment.

The operation of the main side guide drive motor 44 is identical to the operation of the end stop mechanism 34 except that the width of the piling area is adjusted instead of the length. In like manner, the operation of the auxiliary side guide drive motor 127 and its corresponding control 225 are identical to the operation of the main end stop and side guide drive motors 34 and 44, respectively. The auxiliary guide drive motor control 224 causes the carriage upon which the adjustable auxiliary side guides are mounted to be driven out into a position for use and in when they are not used.

The magnetic conveyor comprises three sets of magnets, each set of magnetics including a plurality of the magnets. The first set of magnets are disposed substantially over the first piling area and the third set are disposed substantially over the second piling area. The second or middle set are disposed between the two piling areas and are only used when sheets are to be piled in the second piling area. The first few magnets of the first set are always energized to assure that each sheet is picked up by the magnetic conveyor. The rest of the magnets of the first set may be selectively deenergized in accordance with the sheet size and desired placement within the first piling area. Each of the magnets of the third set may be selectively de-energized for the same reason.

Referring now to the magnetic conveyor control circuit of FIG. 12, it includes magnet selector circuit 231 for the first set of magnets and an identical magnet selector circuit 232 for the second set of magnets. Magnet selector circuit 231 has a shorting switch 233 which is utilized for selecting which magnets will be de-energized for the dropping of a sheet into the first piling area. Magnetic selector circuits 231 and 232 operate in accordance with the description in the aforementioned copending application Ser. No. 523,418 from which a detailed description of the operation of magnet selector circuits 231 and 232 may be obtained.

Associated with the magnetic conveyor are a plurality of proximity switches which sense a passing sheet. The first of the proximity switches is located at the entry of the magnetic conveyor and has contacts 234, 235 and 236. Contacts 234 are coupled to counter 237 which counts each sheet as it enters the magnetic conveyor. Contact 235 is coupled to contactor 240 which places the magnet selections of the first set of magnets under control of magnet selector circuit 231. Likewise, contact 236 is associated with contactor 241 which has contact 242 coupled to contactor 243. Contactor 243 has contact 244 also coupled to contactor 240 so that, while in the alternate piling mode, the magnet selection for the first set of magnets may be achieved by circuit 231.

The second proximity switch is located at the backstop to the first piling area and has a normally closed contact 250 which removes control of the magnet selector process from circuit 231 and causes all of the magnets of the first set to be activated in the alternate pile mode when a sheet is to be dropped into the second piling area. It also has contact 251 which is associated with contactor 240 to cause circuit 231 to select the magnets of the first set when a sheet is to be loaded into the first piling area.

A four section-four position switch 260 is provided to select the pile number 1, pile number 2 or alternate pile modes. In the "ALT" position the sheets will be piled alternately in the first and second piling areas, in the "Pile No. 1" position the sheet will be loaded only into the first piling area, and in the "Pile No. 2" position all of the sheets will be loaded only in the second piling area. Switch 290 is used for placing the system in the auxiliary piling mode.

In operation, for loading the sheets in only the first piling area, switch 260 is set to the Pile No. 1 position and lamp 300 will light. As each sheet passes under the first proximity switch, contact 235 will close and will energize contactor 240. As the sheet then passes the second proximity switch, contact 251 will cause contactor 240 to de-energize and the sheet is dropped into the first piling area.

For loading all of the sheets into the second piling area, switch 260 is set in the Pile No. 2 position which causes lamp 301 to light. All of the magnets of the first and second sets will be energized and each sheet will be loaded into the second piling area under the control of a third proximity switch and its contacts 302. The third proximity switch is located at the backstop of the second piling area.

If alternate piling is desired, switch 210 is set in the ALT position and the magnet selector circuits are adjusted (by switch 233 for circuit 231, for example) to accommodate the sheet lengths. The main side guides are adjusted for the sheet widths and the end stops are adjusted for the sheet length. The auxiliary guides are retracted in the manner previously explained.

When the first sheet covers the first proximity switch, contacts 234 and 235 close, contactors 240 and 241 will energize and all the magnets in the first and second sets will energize. As the first sheet moves forward over the second proximity switch contact 250 opens causing contactor 241 to de-energize. Contact 242 closes and energizes contactor 243. Thus, contacts 244, 235, and 251 are closed. Contact 303 opens and lamp 300 darkens but contact 304 closes lighting lamp 301 indicating that the sheet will go to the second piling area. The sheet then continues and will cause first proximity switch contacts 236 and 235 to open. Further travel of the sheet will uncover the second proximity switch closing contact 250 and the sheet will go to the second piling area. When the third proximity switch is covered, its contact 302 energizes contactor 305 and the third set of magnets. The magnets remain energized until the fourth proximity switch is reached and then the sheet will drop into the second piling area.

The second sheet coming into contact with the first proximity switch causes contacts 236 and 235 to close, energizing contactors 240 and 241. When the second proximity switch is covered, contact 250 is opened and contactor 241 is de-energized causing contact 242 to open and de-energizing contactor 243 contacts 244 and 304 will open and contact 303 will close. Lamp 301 darkens and lamp 300 will light indicating that this sheet will go to the first piling area. When the second sheet passes the first proximity switch, contacts 234 and 235 will open but contactor 240 remains energized through contact 251. After the sheet clears the second proximity switch, contact 250 will close but contactor 241 does not change since contact 236 is open. Contact 251 will open and de-energize contactor 240, causing the first set of magnets to de-energize and to drop the sheet into the second piling area.

The operation continues as above explained with each odd number sheet going to the second piling area and the even sheets going to the first piling area.

If two piles are desired for either piling area the machine is placed in the auxiliary mode. Switch 290 is set "ON" causing contactors 240, 350 and 310 to energize. Contactor 311 will energize except when Pile No. 1 is selected. In this mode no switching of magnets is done for each sheet. It is intended for very short sheets and for multiple piling of the sheets. In the Pile No. 1 position of switch 260, switch 233 will determine how far the sheets are carried in the first piling area. Selection of Pile No. 2 of switch 260 will permit forming the de-energized section where required and still permit travel over to the second piling area.

Prior to loading the sheets, the auxiliary guides are moved into position (via circuit 224 for the first piling area) and the width of the guides adjusted. The edge of the existing pile is then used for length adjustment.

I claim:

1. In a piling machine for handling metal sheets having means defining a pile receiving area with pile supporting means therein, an infeed conveyor means for delivering successive sheets to the entrance end of said pile receiving area, and overhead conveyor means extending above said pile receiving area for advancing the sheets delivered by said infeed conveyor for deposit in said piling area, which conveyor means has associated, adjustable end stop, back stop and side guide mechanisms operative normally to deposit sheets of predetermined dimensional limits in a single pile on said pile supporting means in said piling area: an auxiliary sheet edge guide unit adapted for co-operation with said overhead conveyor means and said associated mechanisms to deposit sheets in a multiplicity of piles in said piling area, means adjustably mounting said auxiliary edge guide unit on said machine adjacent the entrance end of said pile receiving area for movement into and out of operative position relative to said pile receiving area so as to co-operate with said overhead conveyor and its associated end stop and back stop mechanisms and said pile supporting means in depositing sheets in one or more piles in said piling area, said auxiliary edge guide unit including sheet edge guide members which are adjustably mounted on said auxiliary edge guide unit so as to enable said auxiliary edge guide unit, when it is positioned for co-operation with said pile supporting means, to be operated to selectively deposit a plurality of separate piles of sheets in said pile receiving area in side-by-side or in end-to-end relation when the sheets delivered by said infeed conveyor means to said auxiliary sheet edge guide unit are of substantially lesser dimensions than the maximum dimensions of the sheets which the machine normally operates to pile in a single pile on said pile supporting means.

2. In a piling machine as set forth in claim 1 wherein said means mounting said auxiliary sheet edge guide unit on said machine comprises a movable carriage and said sheet edge guide members include a pair of adjustable guide plates mounted on said carriage with guide faces disposed in parallel, vertical planes and spaced transversely on said carriage, which plates extend longitudinally of said carriage and in the direction of travel of the sheets delivered by said infeed conveyor, said guide plates being pivoted on said carriage so that they are free to swing upward upon application of upward force at points spaced from the pivoted connection with said carriage.

3. In a piling machine as set forth in claim 1 wherein said means mounting said auxiliary sheet edge guide unit comprises a movably mounted carriage, an adjusting screw mounted on said machine and extending in the direction of movement of the sheets, and means connecting said carriage to said adjusting screw for movement longitudinally of the machine and in the direction of movement of the sheets so as to enable the carriage to be adjusted for piling sheets in said piling area in multiple piles and disposed in end-to-end relation in the direction lengthwise of the machine.

4. In a piling machine as set forth in claim 1 wherein said means mounting said auxiliary sheet edge guide unit comprises a carriage having an adjusting screw thereon which extends transversely of said unit and said machine and wherein said auxiliary sheet edge guide members comprises a pair of transversely spaced edge guide plates extending in the direction of movement of the sheets and each having a connection with said screw which is operative to move said guide plates toward and from each other upon axial rotation of said adjusting screw.

5. In a piling machine as set forth in claim 1 wherein said machine has pile supporting means in said piling area including a conveyor for moving a pile supporting pallet in a direction laterally of the path of advance of the sheets as they are deposited in said area upon normal operation of the machine and wherein said auxiliary sheet edge guide unit comprises a carriage mounted on said machine and means mounting said sheet edge guide members on said carriage for adjustment toward and from each other in the direction transversely of the direction of movement of the sheets whereby said sheet edge guide unit and said pile supporting pallet may be adjustably positioned relative to each other and to said machine so as to deposit multiple piles of sheets on said pallet in side-by-side relation and in the direction transversely of the direction of the movement of the sheets.

6. In a piling machine as set forth in claim 1 wherein said machine has a back stop mechanism which includes a vertically disposed face for limiting the backward movement of the sheets when they are released by said overhead conveyor and their forward movement is stopped by engagement with said end stop mechanism and said back stop mechanism has a separable portion which is mounted for adjustment longitudinally of the machine and wherein said auxiliary edge guide unit comprises a carriage mounted on said machine for adjustment longitudinally of the machine and in the direction of movement of the sheets, and said sheet edge guide members are adjustable laterally of the direction of movement of the sheets and said guide members are mounted so as to be disposed on opposite sides of said back stop mechanism when said auxiliary edge guide unit is in operative position.

7. In a piling machine as set forth in claim 1 wherein said machine has a back stop mechanism which includes a portion mounted for adjusting movement over said piling area and in a direction lengthwise of the machine and in the direction of the movement of the sheets.

8. In a piling machine as set forth in claim 1 wherein said machine has an infeed conveyor means which comprises a plurality of elongate, longitudinally extending conveyor units which are mounted for individual adjustment with a discharge end adjacent the entrance to said piling area and wherein said back stop mechanism has a back stop plate with a separable top portion and means for adjustably mounting said top portion of said back stop plate on said infeed conveyor discharge end.

9. In a piling machine as set forth in claim 1 wherein said machine has a back stop mechanism disposed at the entrance side of each said pile receiving area which comprises an elongate, upwardly opening housing, means mounting said back stop housing with one end thereof adjacent the entrance side of said pile receiving area and extending in the direction of movement of the sheets and along the longitudinal center of the machine, an elongate support member disposed in said housing, a back stop plate member mounted on a vertical pivot formation at said one end of said support member which is adjacent said piling area, said elongate support member having a pivotal connection with a nut member at the other end thereof, enabling swinging movement of said support member on a horizontal axis, an elongate adjusting screw rotatably mounted in said housing on which said nut is carried and means for operating said adjusting screw to position said back stop plate longitudinally relative to said pile receiving area so as to co-operate with said auxiliary sheet edge guide unit in the piling of sheets in longitudinally spaced relation on said pile supporting means.

10. In a piling machine for metal sheets wherein an overhead sheet carrying conveyor is arranged above a pair of in-line piling areas each having a pile supporting means which is adjustable laterally of the direction of advance of the sheets on said carrying conveyor, an infeed conveyor arranged to deliver successive sheets to said overhead conveyor and means mounted below said overhead conveyor for arresting the movement of and guiding the sheets advanced by said overhead conveyor onto a pile in each of said piling areas, including an end stop mounted for adjustment relative to each said piling area, a back stop and a side guide mechanism, which side guide mechanism is adjustable laterally to a non-operating, out-of-the-way position: the improvement which comprises an auxiliary side guide unit adjustably mounted adjacent the entrance end of each of said piling areas for co-operation with said overhead conveyor and said associated end stop and back stop mechanisms for selectively guiding in a vertical path sheets which are advanced by said overhead conveyor and released for deposit in said piling areas, which auxiliary side guide unit is adjustably mounted for movement to a position for co-operation with said overhead conveyor and the associated end stop and back stop so as to enable multiple piles of the sheets to be formed in side-by-side, or in end-to-end, relation on said pile supporting means.

11. In a piling machine for metal sheets as set forth in claim 10 wherein said overhead conveyor includes longitudinally spaced magnet sections operable through an electric current supply and a control circuit for said current which is operable to advance the sheets for selectively depositing the sheets in the piling areas, and wherein said pile supporting means and said end stop, back stop, and side guide mechanisms include motor drive means operable for adjustably positioning said mechanisms and an associated electrical control circuit which enables said mechanisms to be positioned for forming multiple piles in horizontally spaced relation on said pile supporting means.

12. In a piling machine for metal sheets as set forth in claim 11 wherein said electrical control circuit for said side guide motor drive means which is operable for automatic piling alternately in said piling areas.

13. In a piling machine for metal sheets as set forth in claim 11 wherein said electrical control circuit for said side guide motor drive means is operable for adjusting the position of said pile supporting means and said auxiliary guide means for enabling piling in multiple piles in each of the piling areas in side-by-side relation.

14. In a piling machine for metal sheets as set forth in claim 11 wherein said electrical control circuit for said side guide motor drive means is operable for adjusting said auxiliary guide means for piling in multiple piles in each of said piling areas in end-to-end relation.

15. In combination a machine for piling metal sheets comprising an overhead sheet carrying magnetic conveyor supported above a pair of spaced piling areas, a pile supporting means in each of said piling areas which includes a pile supporting member and a motor driven conveyor means for adjusting the position of said pile supporting member in the direction laterally of the path of advance of the sheets, an infeed conveyor disposed for delivering successive sheets to said overhead conveyor for selective release thereby so as to drop onto a pile supporting means and means co-operating with said overhead conveyor for guiding the sheets advanced by said overhead conveyor onto said pile supporting means in the selected one of said piling areas, which sheet guiding means comprises adjustable end stop, back stop and side guide mechanism, with the side guide mechanism adjustable laterally of the path of the sheets to a non-operating out-of-the-way position and motor drive means for adjusting the position of each of said end stop, back stop, and side guide mechanisms, and an auxiliary side guide mechanism having means for adjustably mounting said auxiliary side guide mechanism adjacent the entrance end of each said piling area for movement into and out of position for co-operation with said overhead conveyor and said associated end stop and back stop mechanisms for selectively guiding sheets which are advanced by said overhead conveyor and released for deposit on said pile supporting means in said piling areas, motor drive means for adjusting said auxiliary guide mechanisms and an electric circuit for controlling the operation of said magnetic conveyor so as to advance the sheets to a selected piling area and for controlling said motor drive means so as to enable piling multiple piles in each of said piling areas.

16. In combination a piling machine as set forth in claim 15 wherein said auxiliary side guide mechanism includes auxiliary side guide members and means to adjustably position said guide members relative to said pile supporting means so as to form multiple piles of the sheets selectively in side-by-side, or end-to-end, relation on said pile supporting members.

17. In combination a piling machine as set forth in claim 16 wherein said electric circuit is arranged to control the operation of said overhead conveyor and associated mechanisms so as to enable automatic piling of alternate sheets in said piling areas.

18. In combination a piling machine as set forth in claim 15 wherein said electric circuit is arranged to control the operation of said overhead conveyor and the adjustment of said pile supporting members and said auxiliary side guide mechanism so as to enable multiple piling in side-by-side relation in said piling areas.

19. In combination a piling machine as set forth in claim 15 wherein said electric circuit is arranged to control operation of said overhead conveyor and said motor drive means for adjusting the position of said pile supporting member and said auxiliary guide mechanism so as to form multiple piles in said piling areas in side-by-side relation.

* * * * *